United States Patent [19]

Milne

[11] Patent Number: 4,837,059

[45] **Date of Patent: * Jun. 6, 1989**

[54] SUPPORT STRUCTURE FOR AN ORNAMENT

[75] Inventor: James A. Milne, Crystal Lake, Ill.

[73] Assignee: CTI Industries, Barrington, Ill.

[ * ] Notice: The portion of the term of this patent subsequent to Mar. 8, 2005 has been disclaimed.

[21] Appl. No.: 154,315

[22] Filed: Feb. 10, 1988

[51] Int. Cl.[4] ..... A63H 3/06

[52] U.S. Cl. ..... 428/12; 446/220; 446/222

[58] Field of Search ..... 24/30.5 L; 428/9, 12, 428/23, 24, 25, 26; 446/220, 222

[56] References Cited

U.S. PATENT DOCUMENTS

| | | | |
|---|---|---|---|
| 1,543,954 | 6/1925 | Shira | 446/222 |
| 1,748,636 | 2/1930 | Crockett | 428/26 |
| 2,664,667 | 1/1954 | Burroughs | 446/222 |
| 2,882,645 | 4/1959 | Stivers | 428/16 X |
| 3,002,240 | 10/1961 | Laguerre | 24/30.5 L |
| 3,041,766 | 7/1962 | Decamp | 428/24 |
| 3,096,766 | 7/1963 | Patton | 24/30.5 L |
| 3,309,742 | 3/1967 | Chin | 24/30.5 L |
| 3,780,419 | 12/1973 | Allison et al. | 446/222 X |
| 4,729,749 | 3/1988 | Milne | 428/24 X |

FOREIGN PATENT DOCUMENTS

| | | | |
|---|---|---|---|
| 271959 | 1/1964 | Australia | 428/100 |
| 290424 | 1/1915 | Fed. Rep. of Germany | 428/24 |

*Primary Examiner*—Henry F. Epstein

*Attorney, Agent, or Firm*—Wood, Dalton, Phillips, Mason & Rowe

[57] ABSTRACT

A support structure is provided for an ornament and consists of a base having an elongate stem with longitudinally spaced first and second stem parts, with the first stem part having a free end, structure for hingedly interconnecting the first and second stem parts for relative movement between (a) a first position wherein the first and second stem parts are in substantially longitudinal alignment and (b) a second position wherein the first and second stem parts are folded against each other with the free end of the first stem part closely adjacent to the second stem part, a sleeve having an opening with first and second spaced ends, structure mounting the sleeve to the base for sliding movement lengthwise relative to the stem between (a) a third position wherein the free end of the first stem part is exposed at the first end of the sleeve opening with the first and second stem parts in the second position and (b) a fourth position wherein the first stem part is at least partially within the sleeve opening with the first and second stem parts in the second position, and structure on the sleeve for maintaining the first and second stem parts in the second position with the sleeve and base in the fourth position.

22 Claims, 1 Drawing Sheet

FIG. 1
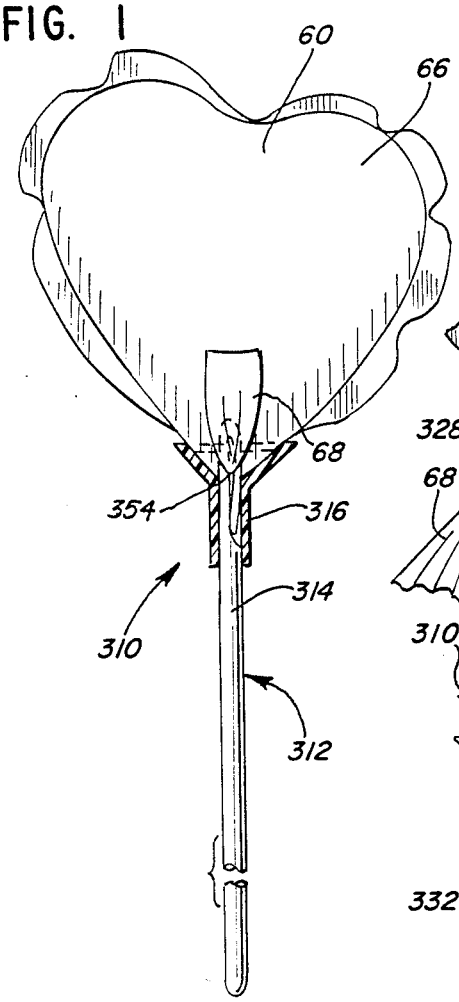
FIG. 4
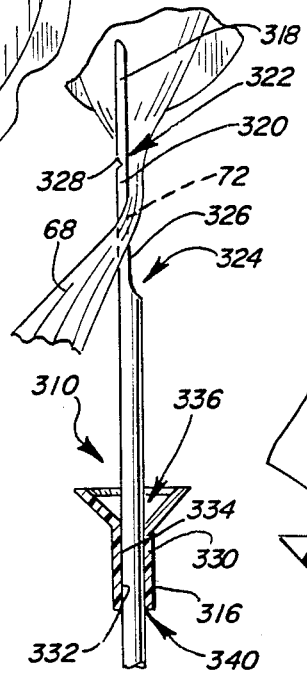
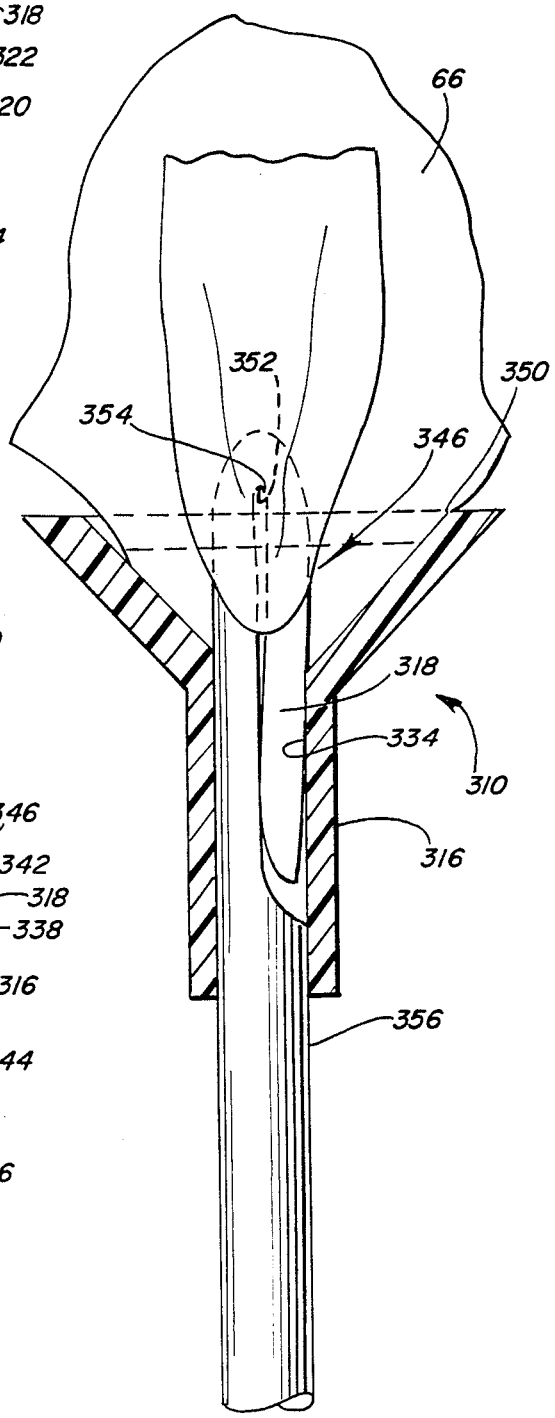
FIG. 6
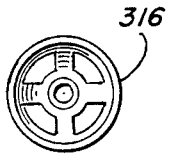
FIG. 2
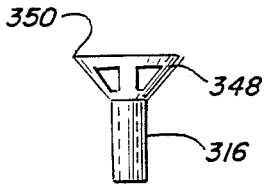
FIG. 3
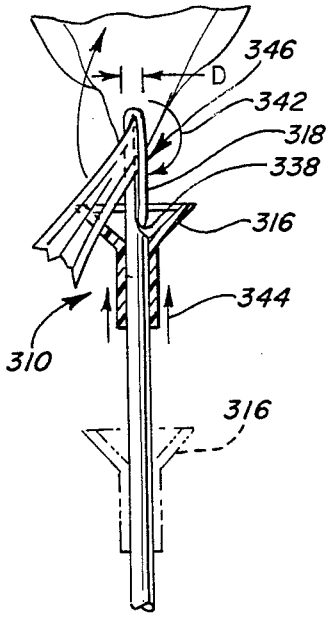
FIG. 5

SUPPORT STRUCTURE FOR AN ORNAMENT

BACKGROUND OF THE INVENTION

1. Field of the Invention

The present invention relates to structure for affixing an ornament, such as a balloon, at the end of a stem-like object.

2. Backqround Art

In recent years relatively small balloons made of plastic film have been affixed at the ends of plain rods, at the ends of artificial rose stems, and similar stem-like members. The plastic film balloons typically are formed of a plurality (two is most common) of panels of plastic laminate film (which may or may not be metallized) with the panels being heat sealed along their edge portions to form the balloon envelope or bulb. A filler port is generally provided in a flexible neck integrally formed with the bulb at the base of the balloon and, after the balloon is inflated, the filler port on the neck may be sealed to prevent escape of gas from the inflated bulb. This sealing can be accomplished as by the use of one-way valves and/or by using heat sealing equipment that fuses the panels at the neck once the bulb is inflated. The balloon neck is available as a means for connecting the balloon to other objects such as rods and artificial stems.

It is common for street vendors and the like to fill balloons on site on an order-by-order basis. Such balloons may not be equipped with one-way valves and generally it is impractical to heat seal the balloon neck with the bulb inflated. Heat sealing equipment may be unaffordable and/or too cumbersome to be transported and kept at the point of sale. Thus, the vendor not only has to securely connect the balloon to a stem prior to sale but must also seal the bulb on site by means of other than valves and heat sealing equipment.

Various connection techniques and means have been used to secure/seal balloons by their necks at the ends of various rods, straws and other stem-like objects (hereinafter referred to as "stems"). One such prior art stem connector comprises a rod having an integral loop at one end that is bendable to define a plane transverse to the axis of the rod. An integral clip-like member is formed near the same end. The balloon neck is threaded through the loop and, after the loop is bent, wrapped around the rod. The wrapped neck material is then pushed under the clip and is restrained thereby from unwrapping.

Another prior art stem connector comprises a cup or funnel-like member having a number of slots formed therein. At the base of the funnel, a tube-like rod holder (i.e., female receptacle) is formed. The balloon neck is inserted into one of the slots of the cup wall, wrapped around the base, and finally inserted into one or more of the other slots to prevent unwrapping.

The foregoing prior art methods and means suffer drawbacks including cumbersome assembly operations and rather unsightly appearance at the point of connection. Further, balloons made from metallized materials are relatively inelastic and as a result do not flex and seal as readily as do conventional latex balloons. The aforementioned devices are, in most cases, unsuitable to both quickly and effectively connect/seal balloons.

It should be understood that the problems contended with in connecting the balloon to a stem are the same as those associated with connecting other type of ornaments to a stem. For example, it is common to attach a non-inflatable ornament, such as a foam-filled ornament, or the like, on the top of a stem. To carry this operation out on site is oft times difficult and time consuming and the result may be a product with an insecure and unsightly connection.

SUMMARY OF THE INVENTION

It is, accordingly, an objective of the present invention to provide improved means for connecting an ornament by its neck at the end of a stem, such means being such as to not only facilitate the assembly (i.e., connection of an ornament to stem) and sealing of the bulb, in the case of a balloon, but also to produce a visually pleasing appearance at the point of connection.

According to the invention, a support structure is provided for an ornament and consists of a base having an elongate stem with longitudinally spaced first and second stem parts, with the first stem part having a free end, structure for hingedly interconnecting the first and second stem parts for relative movement between (a) a first position wherein the first and second stem parts are in substantially longitudinal alignment and (b) a second position wherein the first and second stem parts are folded against each other with the free end of the first stem part closely adjacent to the second stem part, a sleeve having an opening with first and second spaced ends, structure mounting the sleeve to the base for sliding movement lengthwise relative to the stem between (a) a third position wherein the free end of the first stem part is exposed at the first end of the sleeve opening with the first and second stem parts in the second position and (b) a fourth position wherein the first stem part is at least partially within the sleeve opening with the first and second stem parts in the second position, and structure on the sleeve for maintaining the first and second stem parts in the second position with the sleeve and base in the fourth position.

With the inventive structure, a flexible element associated with an ornament can be readily removably placed, and captively held, between the first and second stem parts with the first and second stem parts in the second position and the sleeve and base in the fourth position.

Assembly of the ornament to the support structure involves simply placing the first and second stem parts in the first position with the sleeve in the third position on the stem, extending the flexible neck on the ornament around the second stem part, folding the first stem part against the second stem part to the second position with the neck captively between the first and second stem parts, and repositioning the sleeve relative to the stem so that the sleeve and stem are in the fourth position. By reversing the procedure, the ornament can be released from the support structure.

In one form of the invention, the ornament is a balloon having a bulb bounding an inflation chamber and a flexible neck formed integrally with the bulb and defining a passageway in communication with the bulb inflation chamber to facilitate inflation of the bulb.

The relative dimensions of the sleeve opening and first and second stem parts, with the first and second stem parts in the second position, are chosen so that the first and second parts are snugly embraced by the surface bounding the sleeve opening. With the balloon neck captively between the first and second stem parts in the second position therefor, the first and second stem parts remain slightly spaced from each other. The first and second stem parts, with the balloon neck therebetween, must be forcibly directed into the sleeve opening and, as a result, the neck passageway is positively squeezed between the first and second stem parts to prevent deflation of the bulb through the neck passageway.

To facilitate entry of the first and second stem parts into the sleeve opening, at least one of the stem parts and sleeve is deformable.

In a preferred form, the balloon neck is initially placed between the first and second stem parts at the hinged connection between the first and second stem parts and folded against itself. Upon the sleeve and stem being moved from the third to the fourth position, a surface on the stem, at the hinge, draws against the fold line on the neck and pinches the neck at the fold to thereby further prevent the escape of gas from the bulb through the neck passageway.

As the neck is drawn into the sleeve opening by the stem, the neck progressively bunches up in the sleeve opening to still further seal the neck passageway. As the neck bunches up in the sleeve opening, it becomes wedged and any further pressure applied by the stem on the neck at the fold line more securely seals the neck passageway.

In a preferred form, the sleeve has an integral cup-shaped receptacle for the ornament. The receptacle has a lip which seats the balloon bulb and thereby braces the bulb as the stem draws the folded neck into the sleeve opening to put sealing pressure on the fold line of the neck. The receptacle at the same time shields from view the connecting structure between the stem and balloon neck.

Preferably, the first and second stem parts and interconnecting structure are made from a single piece of flexible material, such as plastic.

The hinge connection between the first and second stem parts consists of a reduced diameter portion to facilitate relative folding between the first and second stem parts.

To facilitate manufacture, the stem is made from thin, cylindrical plastic stock. The diameter of the main portion of the stem is chosen to be closely embraced by the sleeve. The stem parts have a reduced cross-sectional area such that with the first and second stem parts in the second position, they cooperatively occupy a diameter approximately equal to the diameter of the main part of the stem. The hinge between the first and second stem parts has a further reduced cross-sectional area to facilitate relative folding of the first and second stem parts.

The stem can be molded as a single piece in the abovedescribed configuration or alternatively the first and second stem parts can be ground down by conventional techniques to the above-described configuration.

It should be understood that the inventive structure can be used in the same manner to connect a balloon with a pre-sealed bulb to a support. For example, when it is desired that the balloon remain inflated for long periods of time, a one-way valve may be utilized and/or the neck can be heat sealed to block the neck passageway. In this case the inventive structure, in addition to connecting the balloon to a support, affords a redundant seal for the neck passageway.

BRIEF DESCRIPTION OF THE DRAWINGS

FIG. 1 is an elevation view showing a balloon/ornament affixed to a support structure according to the present invention;

FIG. 2 is a plan view of a sleeve associated with the support structure in FIG. 1;

FIG. 3 is a side elevation view of the sleeve in FIG. 2;

FIG. 4 is a fragmentary, side elevation view showing the balloon neck positioned against a stem on the support structure at the initiation of the connection process between the support structure and balloon;

FIG. 5 is a fragmentary, side elevation view, as in FIG. 4, wherein a part of the stem is folded against itself with the balloon neck therebetween and the folded part of the stem is moved from the FIG. 4 position towards an opening in the sleeve; and FIG. 6 is an enlarged, partial section view showing the balloon neck and support structure in a fully assembled state.

DETAILED DESCRIPTION OF THE DRAWINGS

In the drawings, an inflatable, decorative balloon 60 is shown in relationship to a support structure 310 therefor, according to the present invention. The support structure 310 defines a base 312, to which the balloon 60 is connected, and simultaneously seals a passageway 72 defined by the balloon neck 68 for filling the balloon bulb 66. It should be understood that the use of a balloon 60 is only exemplary of one type of ornament that might be utilized, as the connection of a non-inflatable ornament (not shown) to the support structure 310 is also contemplated.

The support structure 310 has an elongate stem 314 and a surrounding sleeve 316 slidable lengthwise of the stem 314. The stem 314 has a cylindrical cross-sectional configuration and is made from a flexible material and preferably a plastic, such as polystyrene.

At the top of the stem 314 there are reduced cross-sectional area first and stem parts 318, 320 respectively. The stem parts 318, 320 are of substantially equal length and interconnected by a hinge portion at 322 having a further reduced cross-sectional area. The hinge 322 permits the first stem part 318 to be moved between a first position, shown in FIG. 4, wherein the first and second stem parts 318, 320 are substantially longitudinally aligned, and a second position shown in FIGS. 1, 5 and 6, wherein the first stem part 318 is folded about the hinge portion 322 against the second stem part 320. With the first and second stem parts 318, 320 in the juxtaposed position, the stem parts 318, 320 effectively occupy a diameter D (FIG. 5) approximately equal to the diameter of the stem 314.

The stem 314 may be made by any of a number of different methods. One method of constructing the stem 314 is to mold the entire stem 314, including the stem parts 318, 320 and hinge 322, as a single piece.

As an alternative, the stem 314 can be formed from cylindrical stock. One end of the stem can then be cut or ground down at 324 to produce a radially facing flat surface 326 extending the length of both the first and second stem parts 318, 320. A V-shaped notch 328 is formed between the first and second stem parts 318, 320 radially oppositely of the flat surface 326 to reduce the cross-sectional area of the stem 314 at the hinge 322 to afford the requisite flexibility between the first and second stem parts 318, 320.

The sleeve 316 has a cylindrical body 330 with a coaxial elongate bore 332 of a diameter to closely, frictionally receive the stem 314. The sleeve surface 334 bounding the bore 332 closely embraces the stem 314 and guides relative sliding movement between the sleeve 316 and stem 314 between a third non-latching, shown in FIG. 4 and in phantom in FIG. 5, and a fourth latching position shown in FIGS. 1 and 6. In the third position, the first stem part 318 is entirely exposed at one axial end 336 of the sleeve bore 332 so that the first sleeve part 318 can be folded without interference between the aforementioned first and second positions. In the fourth position of the sleeve 316 and stem 314, the free end 338 of the first stem part 318 is moved towards the second end 340 of the sleeve bore 332, with the stem parts 318, 320 in the second position, sufficiently that the free end 338 of the first stem part 318 enters the sleeve bore 332. In the fourth position, the sleeve surface 334 surrounds the folded first and second stem parts 318, 320 in the second position therefor and thereby prohibits folding of the first stem part 318 out of the second position i.e. away from the second stem part 320.

To assemble the balloon/ornament 60 to the support structure 310, the sleeve 316 is positioned on the stem 314 in the third position (FIG. 4), wherein the stem part 318 is foldable towards and away from the stem part 320. The flexible balloon neck 68 is then placed against the flat stem surface 326 in the vicinity of the hinge 322 and folded against itself and/or the balloon bulb 66. The first stem part 318 is then pivoted in a clockwise direction, as indicated by arrow 342 in FIG. 5, towards the second stem part 320. This brings the portions of flat surface 326 on the stem portions 318, 320 into facing relationship and as a result the folded neck 68 is closely captured between the stem parts 318, 320. The sleeve 316 is then slid upwardly on the stem 314 in the direction of arrows 344. Upon the free end 338 of the first stem part 318 entering the sleeve bore 332, the surrounding sleeve surface 334 prevents pivoting movement of the first stem portion out of the second position.

The presence of the balloon neck 68 between the stem parts 318, 320 causes a radial bulge at 346 in the stem parts 318, 320 in their second position, so that the effective diameter at 346 is slightly greater than the diameter of the sleeve bore 332. Further upward sliding of the sleeve 316 relative to the stem 314 causes the bulged portion 346 to be squeezed into the sleeve opening 332, which is permitted by a slight deformation of the sleeve body 330. As this occurs, the balloon neck 68 is tightly squeezed between the facing portions of the flat surface 326 so that the neck passageway 72 is sealed when the relative position of the balloon 60 and support structure 310 therefor is as shown in FIGS. 1 and 6.

As the balloon neck 68 is progressively drawn into the sleeve opening 332, the neck material bunches up and is tightly squeezed by the sleeve surface 334. This further seals off the neck passageway 72.

The sleeve 316 has an integrally formed, cup-shaped receptacle 348, with an annular lip 350 that seats the balloon bulb 66 with the balloon 60 and support structure 310 therefor assembled. Further upward pressure on the sleeve 316 relative to the stem 314 from the FIGS. 1 and 6 positions causes a downwardly facing surface 352 on the stem 314 at the hinge 322 to draw on the fold 354 in the neck 68. This action pinches the neck at the fold 354 to further block communication of gas from the bulb 66 through the passageway 72.

It can be seen that the balloon neck passageway 72 is sealed by the combination of the squeezing force on the neck 68 developed by the first and second stem parts 318, 320, by a squeezing force from the sleeve surface 334 on the gathered neck 68 in the sleeve opening 332, and by the pinching force developed by the surface 352 of the stem 314 on the neck fold 354.

The connection between the balloon/ornament 60 and support structure 312 is positively maintained by the frictional forces between the sleeve surface 334 and the stem parts 318, 320, by the frictional forces between the gathered balloon neck 68 and the sleeve surface 334, and by the frictional forces between the sleeve surface 334 and outer surface 356 of the stem 314.

It can be seen that the resulting structure permits positive connection between an ornament with a flexible neck and a stem. In the case of a balloon, by performing the same operation to effect connection, a positive seal of the balloon neck automatically results. At the same time, the ornament can be separated from the stem to permit its replacement.

While preferred constructional features of the invention are embodied in the structure illustrated herein, it is to be understood that changes and variations may be made by those skilled in the art without departing from the spirit and scope of the appended claims.

I claim

1. A support structure for an ornament, said support structure comprising:

a base having an elongate stem with longitudinally spaced first and second stem parts, said first stem part having a free end, said stem including means for hingedly interconnecting the first stem part and second stem part for relative movement between (a) a first position wherein the first and second stem parts are in substantially longitudinal alignment, and (b) a second position wherein the first and second stem parts are folded against each other with the free end of the first stem part closely adjacent to the second stem part;

sleeve having an opening therein with first and second spaced ends;

means mounting the sleeve to the base for sliding movement lengthwise relative to the stem between (a) a third position wherein the free end of the first stem part is exposed at the first end of the sleeve opnning with the first and second stem parts in said second position, and (b) a fourth position wherein the first stem part is at least patially within the sleeve opening with the first and second stem parts in said second position; and means on said sleeve for maintaining the first and second stem parts in said second position with the sleeve and base in said fourth position, whereby a flexible element associated with an ornament can be placed and captively held between the first and second stem parts with the first and second stem parts in the second position and the sleeve and base in the fourth position.

2. The ornament support structure according to claim 1 wherein said first and second stem parts and the interconnecting means comprise a single piece.

3. The ornament support structure according to claim 1 wherein said first and second stem parts and the interconnecting means are made from a single piece of flexible material.

4. The ornament support structure according to claim 3 wherein said flexible material is plastic.

5. The ornament support structure according to claim 3 wherein said first and second stem parts each have a cross-sectional area taken transverse to the length of the stem with the first and second stem parts in said first position, the interconneting means reside longitudinally between the first and second stem parts in said first position and comprises a portion of said stem having a cross-sectional area transverse to the length of the stem less than each of the areas of the first and second stem parts to permit flding of the first and second stem parts relative to each other.

6. The ornament support structure according to claim 3 wherein a portion of said stem has a substantially circular cross section taken transverse to the length of the stem and said first and second stem parts in said second position cooperatively occupy a substantially cylindrical space having a diameter approximately equal to the diameter of said stem portion.

7. The ornament support structure according to claim 6 wherein said means mounting the sleeve to the base comprises a cylindrical surface bounding said sleeve opening, closely frictionally embracing said stem portion and guiding relative sliding movement of the sleeve and stem portion between said third and fourth positions.

8. The ornament support structure according to claim 1 in combination with an ornament having a flexible neck, said neck extending between the first and second stem parts and held captive compressibly between the first and second stem parts with the first and second stem parts in said second position and the sleeve and stem in said fourth position, whereby said ornament is held firmly to the base.

9. The ornament support structure according to claim 8 wherein said ornament comprises an inflatable member with a bulb bounding an inflation chamber, said flexible neck defines a passageway in communication with said bulb inflation chamber and said first and second stem parts compress the neck to seal off the neck and prevent deflation of the bulb with the first and second stem parts in the second position and the sleeve and stem in the fourth position.

10. A support structure for an ornament, said support structure comprising:

a base having an elongate stem with first and second stem parts;

means hingedly interconnecting the first and second stem parts for relative movement between (a) a first position wherein a space is maintained beween said first and second stem parts, and (b) a second position wherein the space between said first and second stem parts is diminished;

a sleeve having an opening therein with first and second spaced ends and bounded by a surface; and means mounting the sleeve to the stem for sliding movement lengthwise relative to the stem between (a) a third position wherein said first and second stem parts are exposed at the first end of the sleeve opening sufficiently that the first and second stem parts can be placed in said first position, and (b) a fourth position wherein said stem is moved relative to the sleeve from the third position by movement of the first and second stem parts towards said second sleeve opening end so that the surface bounding said sleeve opening urges the first and second stem parts towards said second position, whereby a flexible element associated with an ornament can be placed and captively held between the first and second stem parts with the first and second stem parts in the second position and the sleeve and stem in the fourth position.

11. The ornament support structure according to claim 10 wherein said first and second stem parts and the interconnecting means comprise a single piece.

12. The ornament support structure according to claim wherein said first and second stem parts and the interconnecting means are made from a single piece of flexible material.

13. The ornament support structure according to claim 12 wherein said flexible material is plastic.

14. The ornament support structure according to claim 10 wherein said first and second stem parts are each elongate and have a cross-sectional area taken transverse to their length, the interconnecting means comprises a portion of said stem having a cross-sectional area transverse to the length of the stem less than each of the cross-sectional areas of the first and second stem parts to permit folding of the first and second stem parts relative to each other.

15. The ornament support structure according to claim 10 wherein a portion of said stem has a substantially circular cross section taken transverse to the length of the stem and said first and second stem parts in said second position cooperatively occupy a substantially cylindrical space having a diameter approximately equal to the diameter of said stem portion.

16. The ornament support structure according to claim 10 wherein said means mounting the sleeve to the base comprises a cylindrical surface bounding said sleeve opening, closely frictionally embracing said stem portion and guiding relative sliding movement of the sleeve and stem between said third and fourth positions.

17. The ornament support structure according to claim 10 in combination with an ornament having a flexible neck, said neck extending between the first and second stem parts and held captive compressibly between the first and second stem parts with the first and second stem parts in said second position and the sleeve and stem in said fourth position, whereby said ornament is held firmly to the base.

18. The ornament support structure according to claim 17 wherein said ornament comprises an inflatable member with a bulb bounding an inflation chamber, said flexible neck defines a passageway in communication with said bulb inflation chamber and said first and second stem parts compress the neok to seal off the neck and prevent deflation of the bulb with the stem parts in the second position and the sleeve and stem in the fourth position.

19. The ornament support structure according to claim 18 wherein said sleeve has an enlarged cup-shaped receptacle within which the balloon bulb can nest.

20. A support structure for an ornament, said support structure comprising:

a base having an elongate stem provided with first and second stem parts, said first stem having a free end, said stem including means for hingedly interconnecting the first stem part and the second stem part for relative angular movement between (a) a first position which the first stem part is spaced from the second stem part, and (b) a second position in which the first stem part is angularly swung into juxtaposition with the second stem part; and embracing means longitudinally slidable on said elongate stem between a non-latching position and a latching position in which the embracing means closely frictionally engages the juxtaposed first and second stem parts in said second position to retain said first and second stem parts in said second position, whereby a flexible element associated with an ornament can be placed and captively held between the juxtaposed first and second stem parts in said second position.

21. The ornament suppport structure according to claim 20 in combination with an ornament having a flexible neck, said neck extending between the first and second stem parts and held captive compressibly therebetween when the first and second stem parts are in said second position and the embracing means is in said latching position.

22. The ornament support structure according to claim 21 wherein said ornament comprises an inflatable member with a bulb bounding an inflation chamber, said flexible neck defines a passageway in communication with said bulb inflation chamber and said first and second stem parts compress the neck to seal off the neck and prevent deflation of the bulb when the first and second stem parts are in said second position and the embracing means is in said latching position.

* * * * *